US005509401A

United States Patent [19]

Trubic

[11] Patent Number: 5,509,401

[45] Date of Patent: Apr. 23, 1996

[54] ROTARY BOW SIGHT

[76] Inventor: Donald R. Trubic, 90 Arlington Dr., Warren, Pa. 16365

[21] Appl. No.: 205,779

[22] Filed: Mar. 3, 1994

Related U.S. Application Data

[63] Continuation of Ser. No. 874,851, Apr. 28, 1992, abandoned.

[51] Int. Cl.[6] ..... F41G 1/46

[52] U.S. Cl. ..... 124/87; 124/86; 33/265

[58] Field of Search ..... 124/87, 86, 88, 124/23.1, 25.6; 33/265

[56] References Cited

U.S. PATENT DOCUMENTS

| | | | |
|---|---|---|---|
| 2,654,152 | 10/1953 | La Vire | 33/265 |
| 3,310,875 | 3/1967 | Kowalski | 33/265 |
| 3,579,839 | 5/1971 | Kowalski | 33/265 |
| 3,822,479 | 7/1974 | Kowalski | 33/265 |
| 4,020,560 | 5/1977 | Heck | 33/265 |
| 4,162,579 | 7/1979 | James | 124/87 X |
| 4,543,728 | 10/1985 | Kowalski | 33/265 |
| 4,726,123 | 2/1988 | Keller | 33/265 |
| 4,823,474 | 4/1989 | Reynolds | 33/265 |
| 4,846,141 | 7/1989 | Johnson | 124/87 |
| 4,884,347 | 12/1989 | Larson | 33/265 |
| 4,910,874 | 3/1990 | Busch | 124/87 X |
| 5,050,576 | 9/1991 | Larson | 124/87 |
| 5,072,716 | 12/1991 | Sappington | 124/87 |
| 5,122,932 | 6/1992 | Ziller | 124/87 X |

*Primary Examiner*—Kenneth J. Dorner
*Assistant Examiner*—Harry C. Kim

[57] ABSTRACT

A rapidly and easily adjustable bow sight for use with an archery bow includes a plate arranged for removable attachment and adjustment to the archery bow, and supporting a C-shaped support member at its forward end, to which is attached a rotatable member in a substantially vertical position, between the legs of the C-shaped support member. Extending through the arm of the C-shaped support member and contacting the rotatable member is a stubby plunger device or spring and ball arrangement that engages indentations in the rotatable member for the purpose of maintaining the desired true position. Mounted on the rotatable member are a plurality of sight elements at various compass locations when viewed from above, so that only the desired sight element(s) selected by the archer appear(s) in the sight window of the bow at any one time. Each sight element is temporarily locked in position on the rotatable member and can be adjusted horizontally, horizontally and vertically, or vertically as required.

5 Claims, 5 Drawing Sheets

*BOTTOM VIEW*

ROTARY BOW SIGHT

This application is a continuation of application Ser. No. 07/874,851, filed Apr. 28, 1992, now abandoned.

FIELD OF THE INVENTION

This invention relates to the field of Archery and in particular to an improved bow sight mechanism having the means for the archer to preset multiple sight elements as he desires in such a manner so that only one sight element at a time will be in the sight window of the bow.

BACKGROUND OF THE INVENTION

The sport of Archery has been in existence for hundreds of years used as a means of hunting fish and game and as a form of recreation. In all instances it is advantageous to not only hit the intended target but to hit the intended target in the desired location taking into account the effects of gravity and the individual archers equipment preference and shooting style. Thus devices for aiding and improving accuracy are continually being sought. Some archers are proficient through "instinctive" shooting and do not require sight aids of any type. The great majority of archers, however, rely on sight aids of some type to hit the desired location on the intended target.

The prior art shows various bow sights of two main varieties. One variety is of the type taught by Johnson U.S. Pat. No. #4,846,141 that uses multiple fixed sight pins or other indices extending horizontally from the bow sight in such a manner so that the sight "beads" or aiming points are spaced in a substantially vertical alignment to denote various distances to the target from the archer.

It is very easy to become confused with this arrangement as a result of a condition commonly referred to as "pin clutter" whereby all sight beads or aiming points are contained within the sight window of the bow at the same time. The archer sees all the sight elements when attempting to aim. The Archer must carefully distinguish and use the correct sight element for the estimated distance from the apparent group of sight elements when releasing the arrow. This problem is enhanced with the current innovations in archery equipment that allow a flatter trajectory and thus require closer and closer alignment of the sight beads in relation to each other.

It is very easy for the archer to use the wrong sight element when aiming at the intended target and miss by a wide margin as a result.

Another condition commonly referred to as "target panic" is easily experienced when all sight pins are in the target window at the same time. This condition causes the archer to unwillingly tense up, flinch, jerk or prematurely release the arrow before the correct sight element is utilized because of the close proximity of any of the adjacent sight elements to the target. As a result the archer misses the intended target by a wide margin. This problem is also enhanced by the new innovations in archery equipment that allow a flatter trajectory and thus require closer and closer alignment of the sight beads in relation to each other.

This variety of bow sight allows for individual and independent adjustment for windage and distance for each of the sight elements contained by the bow sight and thus allows for tilting or canting the bow according to the individual archers shooting style. This type of sight is usually defined as fixed pin sight when shooting competitively.

The other common variety of bow sight is of the type of a single pin as shown in Keller U.S. Pat. No. 4,726,123 and Reynolds U.S. Pat. No. 4,823,474. A single sight element is more accurate because there is no confusion between sight elements or in the selection of the correct pin to use as the proper sight element. These patents teach movement of a single pin in some manner to account for different distances to the target. These sights depend on the archer to hold the bow and thus the bow sight in a exact 90 degree position in order for the windage to remain constant as the distance changes. Any tilting or canting of the bow from the exact 90 degree position will necessarily cause the windage to be incorrect as the distance adjustment is made and will cause the order to miss the intended target.

These sights require that the archer devote most of his attention and efforts to setting the correct yardage on the bow sight for each and every distance because of the very fine adjustments on a graduated scale and away from the intended target. The precision required in making the distance adjustment is relatively time consuming especially when used for hunting fish and game.

This type of sight is generally defined as infinitely adjustable and generally requires the archer to be in the more competitive class when shooting in archery competition.

SUMMARY OF PRESENT INVENTION

The present invention concerns an archery bow sight having a means of quickly and easily utilizing multiple preset sight elements in such a manner that only one sight element at a time is present in the sight window of the bow. The present sight includes a means for mounting on a majority of bows in a substantially vertical manner by means of a base arrangement permitting a wide range of sight and bow combinations. Said base allows for adjustability of bow sight on the bow. The base is attached to a C Shaped Support Frame. Mounted in a substantially vertical position between the legs of the C Shaped Support is a Rotatable Member. Mounted to this Rotatable Member are a plurality of Sight Elements at various compass locations when viewed from above. These Sight Elements are mounted in such a way that only one Sight Element appears in the sight window at a time. The Rotatable Member has a means whereby the desired Sight Element is rotated to a precise predetermined position and is held firmly in that position until another sight element is chosen and rotated into position. The Sight Elements are attached to the Rotatable Member in such a way as to permit independent and individual adjustment for windage and independent and individual adjustment for distance for each separate sight element. To use the present sight the archer must set the Sight Elements to whatever distances the archer predetermines through trial and error commonly called "sighting in".

The archer does this by predetermining a yardage, rotating the desired Sight Element into the sight window and adjusting the Sight Element on the Rotatable Member up or down and in or out until the arrows are hitting the intended point. The archer then predetermines the next distance, rotates the next Sight Element into position and repeats the process until all sight elements are sighted in.

When shooting competitively or in a hunting situation the archer must accurately assess the distance, choose the correct Sight Element and quickly rotate that Sight Element into the preset and locked position, aim, and release the arrow.

Rotation of the Rotatable Member is accomplished by a quick partial twist of the Rotatable Member to any of the predetermined and preset positions. Important objectives of present bow sight include the provision of having a plurality of preset and predetermined Sight Elements arranged in such a manner that only the preferred Sight Element is in the sight window as desired by the archer; independent and individual adjustment of each of the Sight Elements on the Rotatable Member thus allowing canting or tilting of the bow as long as it is done consistently: a means of quickly and easily rotating the Rotatable Member to the preset position and temporarily locking it into the correct position for shooting by a simple partial twist of the Rotatable Member: a means of identifying the correct Sight Element for the estimated yardage: classification when shooting in archery competition as "fixed pins" and therefore a more desirable level of competition; a means for readily attaching the present sight to a wide variety of bows including a means for adjustment when attaching to the bow.

DESCRIPTION OF THE PREFERRED EMBODIMENT

Figure 1:
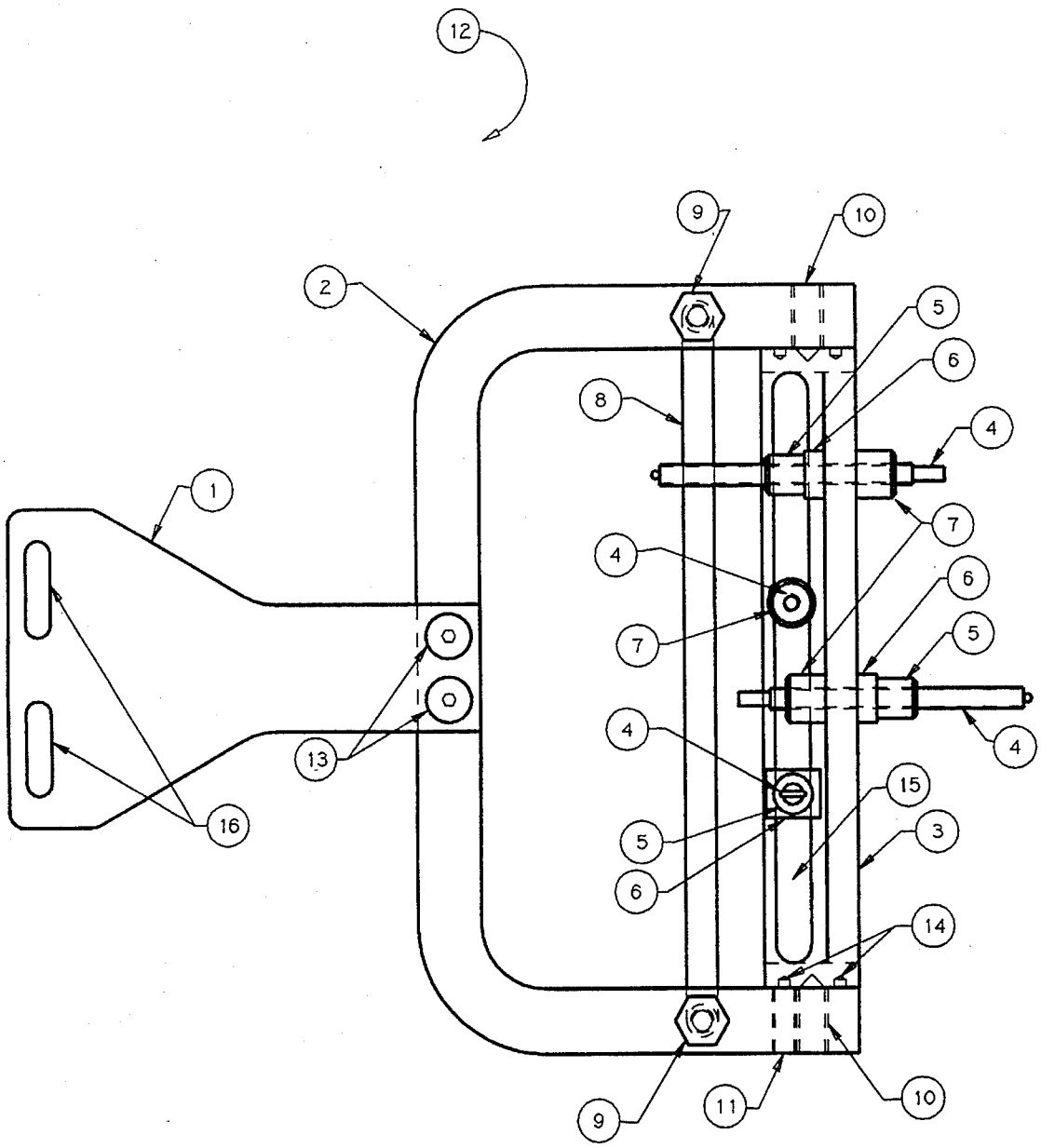
FIG. 1 is a right side view of a rotary bow sight in accordance with the present invention.

For the purposes of promoting an understanding of the present invention, reference will now be made to the embodiment illustrated in the drawings and specific language will be used to describe the same. It is nevertheless to be understood that no limitation of the scope of the invention is thereby intended. The proper scope of the invention being indicated by the claims appended below and equivalents thereof.

Figure 2:
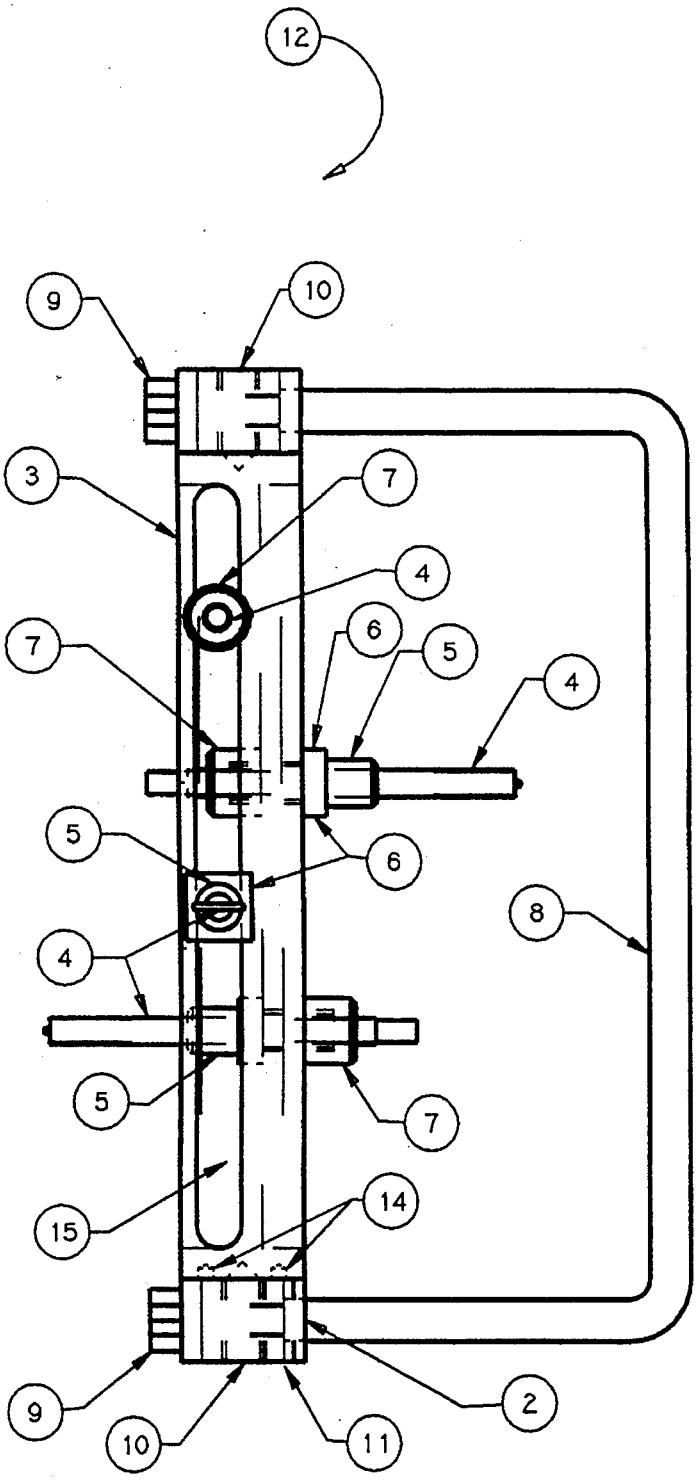
FIG. 2 is a front view of a rotary bow sight of FIG. 1.
Figure 3:
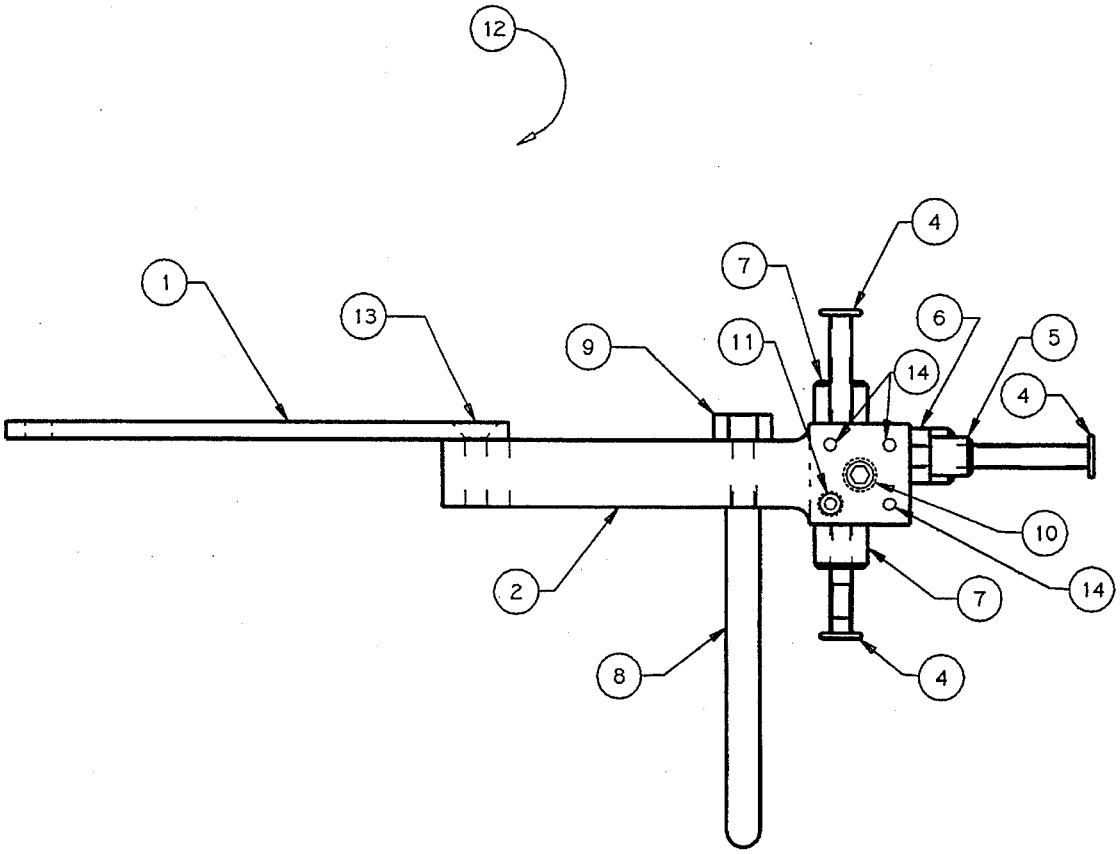
FIG. 3 is a bottom view of a rotary bow sight of FIG. 1.

Referring to FIGS. 1–3, there is illustrated a Rotary Bow Sight 12 in accordance with the present invention. Rotary Bow Sight 12 includes a C-Shaped Support Frame 2, rigidly attached to Base Plate 1 by Support Frame Fasteners 13. Said Base Plate 1 includes Mounting Slots 16 for mounting to the median portion of the bow. Said Mounting Slots 16 are elongated to provide a means for adjustment when mounting Rotary Bow Sight 12 to median portion of Bow. Mounted in a substantially vertical position between the C-Shaped Support Frame 2 is the Rotatable Member 3. The Rotatable Member 3 is securely fastened to the C-Shaped Support Frame 2 by means of Threaded Fasteners 10.

The Rotatable Member 3 is a L-shaped member containing Sight Element Slot 15 in each leg of the L of the Rotatable Member 3. The Rotatable Member 3 contains a plurality of Positioning Indentations 14 for positioning and holding the Rotatable Member 3 in true position. The Stubby Plunger 11 is a spring and ball combination mounted in the C-Shaped Support Frame 2 and extending to contact with Rotatable Member 3. The Stubby Plunger 11 has the means for engaging the Positioning Indentations 14 in such a manner as to hold the Rotatable Member 3 in true position until minimal pressure is exerted by the archer to rotate the Rotatable Member 3 to the next desired location. Mounted perpendicular and substantially horizontally to the Rotatable Member 3 and through the Sight Element Slots 15 are a plurality of Sight Pin Elements 4. These Sight Pin Elements 4 are fastened to the Rotatable Member 3 by means of Sight Pin Holders 6. The Sight Pin Holders 6 are threaded internally to accept the Sight Pin Element 4 and threaded externally to engage the Vertical Adjustment Lock Nut 7. The Sight Pin Holder 6 is such that only one end of the Sight Pin Holder 6 passes through the Sight Element Slot 15. The opposite end of the Sight Pin Holder 6 rests against the Vertical Rotatable Member 3. The Sight Pin Holder 6 is partially inserted through the Sight Element Slots 15 and engaged by the Vertical Adjustment Lock Nut 7. To position the Sight Element Assembly 4, 6, 7 vertically the Sight Element Assembly 4, 6, 7 is moved to the desired position and Vertical Adjustment Lock Nut 7 tightened onto Sight Pin Holder 6 until Vertical Adjustment Lock Nut 7 contacts Vertical Rotatable Member 3 and is tight.

The Horizontal Adjustment Lock Nut 5 has internal threads and is threaded onto the Sight Pin Element 4 in such a way, that it will contact the Sight Pin Holder 6 when tightened.

To adjust the Sight Element 4 horizontally, the Horizontal Adjustment Lock Nut 5 is loosened and the Sight Pin Element 4 is screwed into or out of the Sight Pin Holder 6 until the desired position is achieved. The Horizontal Adjustment Lock Nut 5 is then screwed over the Sight Pin 4 and tight against the Sight Pin Holder 6 thus maintaining the correct horizontal position.

Sight Element Guard 8 is threaded on both ends. The threaded ends of Sight Element Guard 8 are inserted in holes through the C-Shaped Support Frame 2 and held securely in place by Sight Guard Lock Nut 9. The Sight Element Guard 8 can be positioned on either side of C-Shaped Support Frame 2.

Figure 4A:
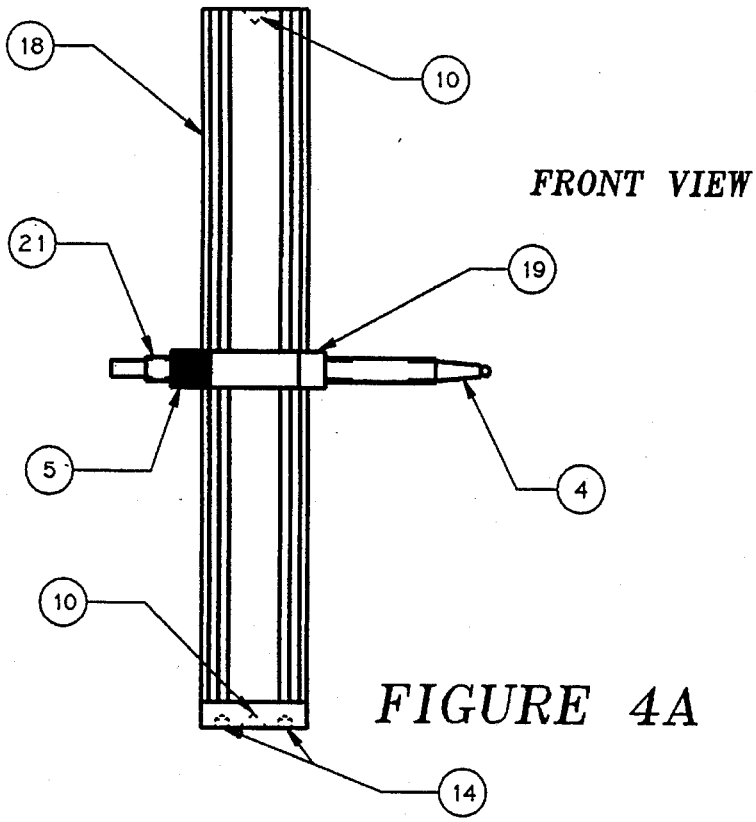
FIG. 4A is a front view of an alternate dovetail rotatable member useable with rotary bow sight in accordance with the present invention.
Figure 4B:
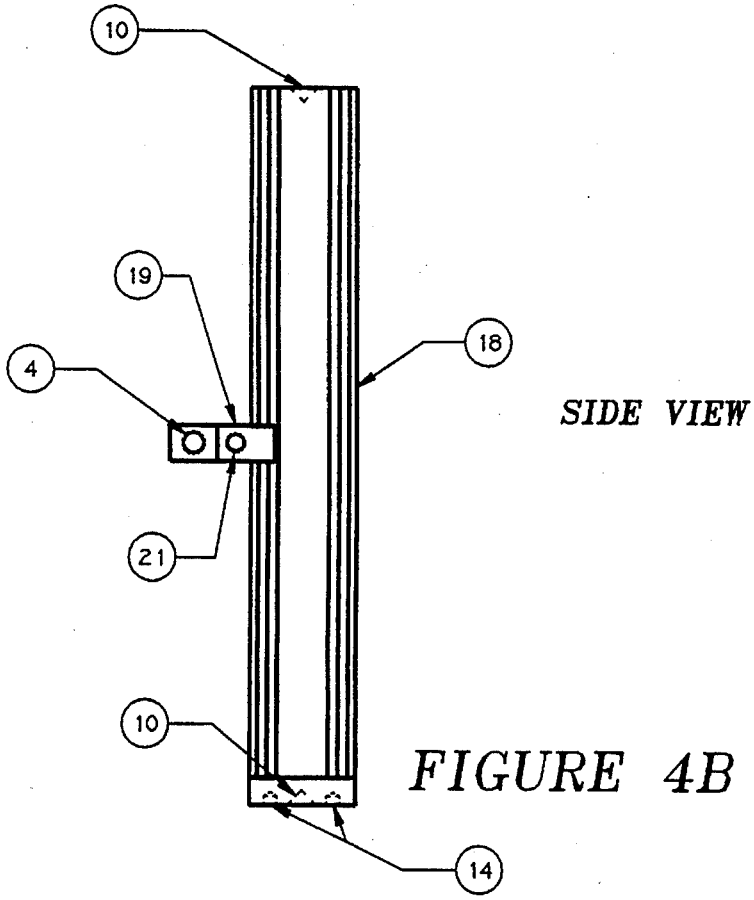
FIG. 4B is a side view of alternate dovetail rotatable member of FIG. 4A.
Figure 4C:
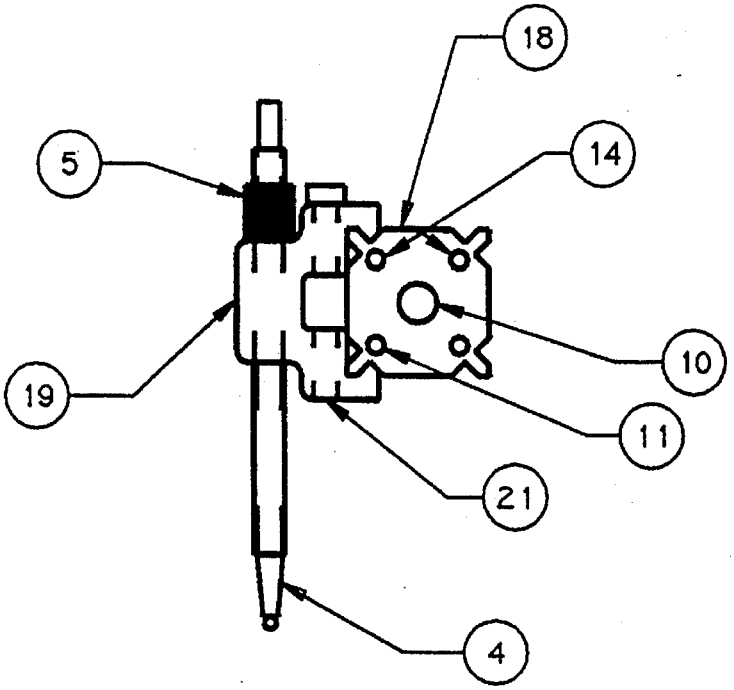
FIG. 4C is a bottom view of alternate dovetail rotatable member of FIG. 4A.

Referring to FIGS. 4A, 4B and 4C, there is illustrated an Alternate Dovetail Rotatable Member 18. The Alternate Dovetail Rotatable Member 18 is securely fastened to the C-Shaped Support Frame 2 of FIG. 1, by means of Threaded Fasteners 10 of FIG. 1. The Alternate Dovetail Rotatable Member 18 is a multi-sided piece comprised of lengthwise dovetail slots in such a way that a plurality of Dovetail Mounting Brackets 19 can engage the dovetail slots of any of the sides of the multi-sided piece, and be temporarily locked in place by tightening Lock Screw 21, which is externally threaded and engages internal threads that are contained in the opposing ends of the Dovetail Mounting Bracket 19. The Alternate Dovetail Rotatable Member 18 contains a plurality of Positioning Indentations 14 for positioning and holding the Alternate Dovetail Rotatable Member 18 in true position. The Stubby Plunger 11 of FIG. 1 is a spring and ball combination mounted in the C-shaped Support Frame 2 of FIG. 1, to contact with Alternate Dovetail Rotatable Member 18. The Stubby Plunger 11 of FIG. 1 engages the Positioning Indentations 14 of FIG. 4A in such a manner as to hold the Alternate Dovetail Rotatable Member 18 in true position until minimal pressure is exerted by the archer to rotate the Alternate Dovetail Rotatable Member 18 to the next desired location. Mounted perpendicular and in a substantially horizontal position to the Alternate Dovetail Rotatable Member 18 and through the Dovetail Mounting Brackets 19, is a Sight Pin Element 4. The Dovetail Mounting Brackets 19 are threaded internally to accept the Sight Pin Element 4. Mounted on the Sight Pin Element 4 is a Horizontal Adjustment Lock Nut 5. The Horizontal Adjustment Lock Nut 5 has internal threads and is threaded onto the Sight Pin Element 4 in such a way, that it will contact the Dovetail Mounting Bracket 19 when tightened.

While the above description contains many specifications, these should not be construed as limitations on the scope of the invention, but rather as an exemplification of one preferred embodiment thereof. Many other variations are possible, for example:

a. round, square, dovetail or other irregular shaped rotatable members b. dovetail mounting brackets or other means of mounting sight elements to rotatable member c. one piece construction of base plate and C-Shaped Support Frame d. dovetail mounting bases for mounting sight to bow e. more or less positioning indices for positive location of rotatable member f. The ability to arrange all sight pin elements in the same mounting slot for use as a conventional bow sight and the ability to rotate these sight pin elements in such a manner that they are protected while transporting the bow g. square or irregular shaped Support Frame h. positioning indentations and Stubby Plunger on upper arm of Support Frame or on both arms of Support Frame Accordingly, the scope of the invention should be determined not by the embodiment illustrated but by the appended claims and legal equivalents.

What is claimed is:

1. An archery bow sight comprising, a plurality of sight elements, a substantially flat vertical base plate having first and second ends, said first end of said base plate being adapted for mounting an archery bow thereon, a C-shaped support frame, said support frame having a vertical central portion and two horizontal extensions, said vertical central portion being secured to said second end of said base plate in a substantially vertical position, and a rotatable member, said rotatable member including means for mounting said plurality of sight elements thereon, said rotatable member being rotatably and adjustably mounted between said two horizontal extensions for allowing said plurality of sight elements to move together as the rotatable member is rotated, and said mounting means comprising a plurality of longitudinal slots formed on said rotatable member for adjustably mounting each of said plurality of sight elements thereon.

2. The archery bow sight of claim 1 wherein said sight includes means for rotating and positioning said rotatable member to a plurality of preset positions.

3. The archery bow sight of claim 2 wherein said means for rotating and positioning said rotatable member further comprises a plurality of positioning indentations on said rotatable member.

4. The archery bow sight of claim 3 wherein said means for rotating and positioning said rotatable member further comprises a spring loaded ball or plunger on said C-shaped support frame for engaging with said plurality of positioning indentations.

5. The archery bow sight of claim 1 wherein said each of said plurality sight elements includes means for vertical and horizontal adjustment in relationship to the rotatable member.

* * * * *